US006650851B2

(12) United States Patent
Adams et al.

(10) Patent No.: US 6,650,851 B2
(45) Date of Patent: Nov. 18, 2003

(54) COMBINED CHARGE/RECHARGE XEROGRAPHIC POWER SUPPLY

(75) Inventors: Jerry F. Adams, Waterport, NY (US); Peter G. Fournia, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 13 days.

(21) Appl. No.: 09/683,586

(22) Filed: Jan. 22, 2002

(65) Prior Publication Data

US 2003/0138264 A1 Jul. 24, 2003

(51) Int. Cl.[7] ..... G03G 15/02
(52) U.S. Cl. ..... 399/89; 399/171
(58) Field of Search ..... 399/50, 89, 168, 399/170, 171; 250/324, 325, 326; 361/225, 229, 230, 234

(56) References Cited

U.S. PATENT DOCUMENTS 4,141,648 A * 2/1979 Gaitten et al. ..... 399/89

* cited by examiner

*Primary Examiner*—Hoang Ngo
(74) *Attorney, Agent, or Firm*—Oliff & Berridge, PLC

(57) ABSTRACT

A combined charge/recharge xerographic power supply is provided that utilizes one power supply to drive the charge pin scorotron and recharge discorotron grids of a electrophotographic or xerographic system. The power supply uses recycled power from the pin scorotron grid to drive the discorotron grid. In particular, the power supply uses power that is dissipated in the traditional shunt regulator attached to the pin scorotron grid terminal to drive and provide active current to the discorotron grid through a series-pass regulation circuit. Thereby providing reduced electromagnetic emissions and reduced unit manufacturing costs.

20 Claims, 5 Drawing Sheets

COMBINED CHARGE/RECHARGE XEROGRAPHIC POWER SUPPLY

BACKGROUND OF THE INVENTION

1. Field of Invention

This invention relates to systems and apparatus for recycling scavenged power from a pin scorotron grid to drive a discorotron grid in an electrophotographic or xerographic system.

2. Description of Related Art

The xerographic imaging process is initiated by charging a charge retentive surface, such as that of a photoconductive member, to a uniform potential. The charge retentive surface is then exposed to a light image of an original document, either directly or via a digital image driven laser. Exposing the charged photoconductor to light selectively discharges areas of the charge retentive surface while allowing other areas to remain unchanged. This creates an electrostatic latent image of the document on the surface of the photoconductive member.

Developer material is then brought into contact with the surface of the photoconductor material to develop the latent image into a visible reproduction. The developer typically includes toner particles with an electrical polarity that is the same as, or that is opposite to, the polarity of the charges remaining on the photoconductive member. The polarity depends on the image profile.

A blank image receiving medium is then brought into contact with the photoreceptor and the toner particles are transferred to the image receiving medium. The toner particles forming the image on the image receiving medium are subsequently heated, thereby permanently fixing the reproduced image to the image receiving medium.

Electrophotographic or xerographic laser printers, scanners, facsimile machines and similar document reproduction devices must be able to maintain proper control over the systems of the image forming apparatus to assure high quality output images. For example, the level of electrostatic charge on the photographic member must be maintained at a certain level to be able to attract the charged toner particles.

FIG. 1 shows an exemplary embodiment of an image forming apparatus 100 having a photoreceptor 120. The image forming apparatus 100 can be a xerographic printer or other known or later developed xerographic device. It should be appreciated that the specific structures of the image forming apparatus are not relevant to this invention and thus are not intended to limit the scope of this invention.

As shown in FIG. 1, one or more latent images can be generated on the photoreceptor 120 in any well known manner, by controlling one or more of a number of different developer units 150A, 150B, 150C and 150D using controller 110.

In many xerographic machines, where high image quality targets are desired, the photoreceptor is first charged using a pin scorotron device, and then recharged, or charge leveled, by a discorotron device. For example, as shown in FIG. 1, in the direction of movement of the photoreceptor 120, as indicated by the arrows, to lay a first level of toner onto the photoreceptor, the photoreceptor 120 is charged by charge/recharge device 130E having a pin scorotron and a discorotron device. Next, the charge laid by the charging device is exposed by exposing unit 140E and finally, the toner is developed by developing unit 150E. The process continues in the direction of movement of the photoreceptor until all layers of toner are laid to complete an image-on-image full-color image forming process. Once the full-color image is finished, the completed image is transferred to a sheet of image recording media 160.

The charging procedure of the charge/recharge device is performed to produce a very uniform charge on the photoreceptor. This uniform charge is especially important in the image-on-image type xerographic color machines, as shown in FIG. 1, where the photoreceptor may be buried under multiple layers of toner. Typically, the pin scorotron device is set to charge the photoreceptor to a voltage slightly higher than the final voltage, and the discorotron is then used to discharge the photoreceptor uniformly to the desired voltage.

FIG. 2 represents a typical configuration of a charge/recharge system 200 that is usable in a xerographic system. The left side of the configuration represents the pin scorotron device 270, while the right side of the configuration represents the discorotron device 210. In the pin scorotron device 270, a high-voltage DC signal is applied to the pins 240 by a pin current supply 250. The applied voltage is sufficiently high to cause corona discharge at the pins 240. This discharge provides a path for a pin current to be applied to a pin scorotron grid 245. The pin scorotron grid 245 is located between the photoreceptor 120 and the pins 240 so that the majority of the pin current is absorbed by the pin scorotron grid 245. The grid is held at a constant voltage by the pin scorotron grid voltage control circuit 260, which is a simple shunt regulator type circuit. The pin scorotron grid voltage control circuit 260 operates in a linear manner to achieve a variable resistance network to ground. The resistance of the pin scorotron grid voltage control circuit 260 can be controlled to either increase or decrease its voltage drop to achieve the desired grid voltage.

The discorotron device comprises a shield 225 formed of aluminum or the like and having an open lower end, a corona discharge electrode 230, such as a glass coated tungsten wire or the like, extending within the shield 225, and a discorotron grid 235 disposed opposite the opening of the shield 235 and between the shield 225 and the photoreceptor 120. The discorotron device 210 operates in much the same manner as the pin scorotron device 270. The discorotron grid 235 is typically driven by an active power source, such as the grid voltage active control circuit 215. The discorotron high-voltage AC source 220 is connected to the corona discharge electrode 230 to produce a corona discharge.

SUMMARY OF THE INVENTION

As shown in FIG. 2, the pin scorotron device 270 and the discorotron device 210 are driven by separate power supplies. However, there is available power in the pin scorotron grid voltage control circuit 260 that can be recycled and used to drive and control the discorotron grid 235.

The inventors have discerned that the power that is dissipated in the pin scorotron grid voltage control circuit 260 can be used to drive the discorotron grid 235.

This invention provides systems and apparatus that provide reduced power dissipation in the high voltage power supply.

This invention separately provides possible direct programming of the voltage applied to the photoreceptor and the voltage between the pin scorotron grid and the discorotron grid rather than by indirect programming of the voltage applied directly to the pin scorotron grid and the discorotron grid.

This invention separately provides reduced electromagnetic emissions and increased arc immunity of the discorotron due to a better controlled xerographic current path. The reduced emissions is achieved because the discorotron grid is not driven by an active power supply.

In various exemplary embodiments of the systems and apparatus of this invention, the active power source that is typically used to drive the discorotron grid is removed. According to the systems and apparatus of this invention, the discorotron grid instead utilizes a combined circuit which uses the power dissipated in the traditional shunt regulation circuit that drives the pin scorotron grid to drive the discorotron grid through a series pass regulation circuit. The current flow of the combined circuit naturally flows in a direction to allow shunt regulation of the pin scorotron grid while also providing an active drive voltage for the discorotron grid.

These and other features and advantages of this invention are described in or are apparent from the following detailed description of the apparatus and systems according to this invention.

BRIEF DESCRIPTION OF THE DRAWINGS

Various exemplary embodiments of this invention will be described in detail with respect to the following drawings, in which like reference numerals indicate like elements, and wherein.

DETAILED DESCRIPTION OF EXEMPLARY EMBODIMENTS

Figure 1:
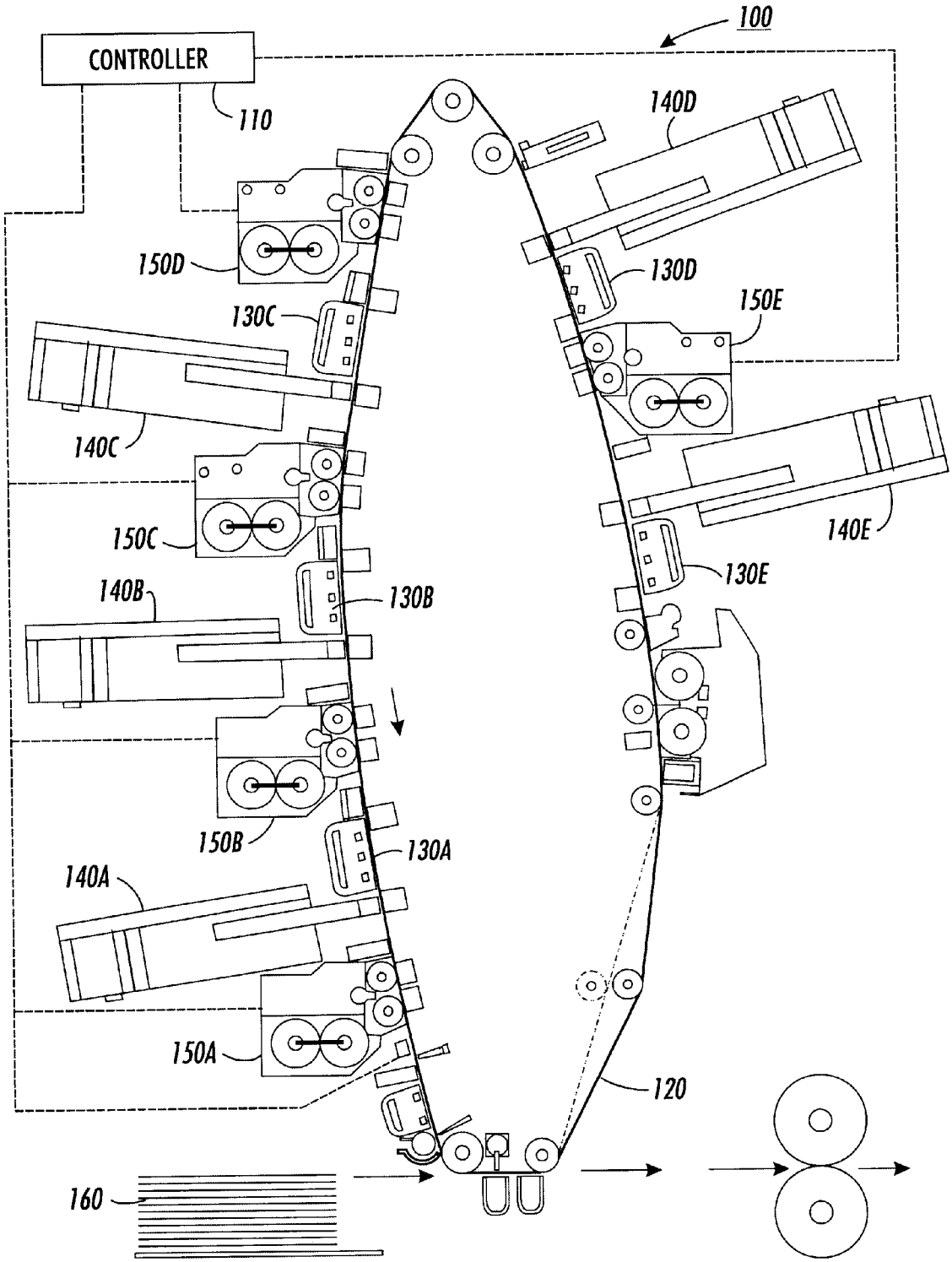
FIG. 1 depicts an exemplary embodiment of a xerographic image forming apparatus in which an exemplary combined charge/recharge xerographic power supply according to this invention may be used to charge a photoreceptor.
Figure 2:
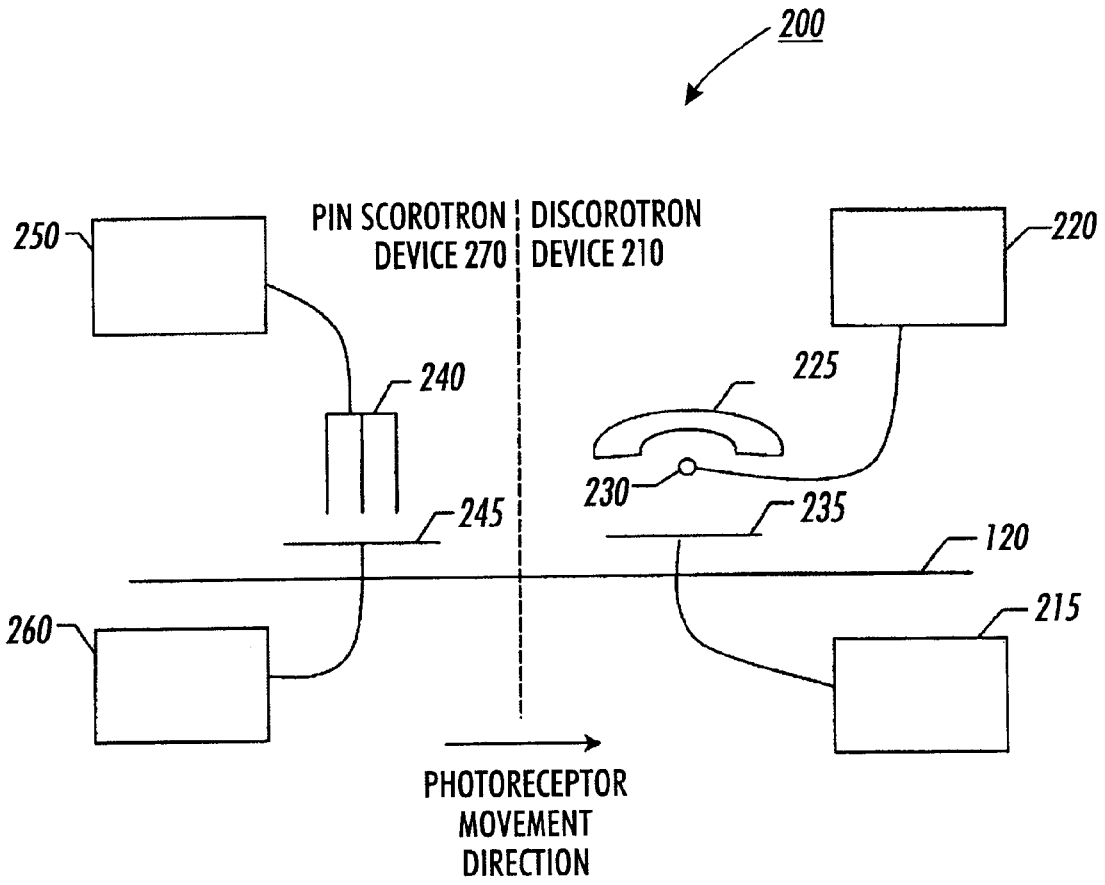
FIG. 2 (Prior Art)
FIG. 2 depicts an exemplary representation of a typical configuration of a charge/recharge device.
Figure 3:
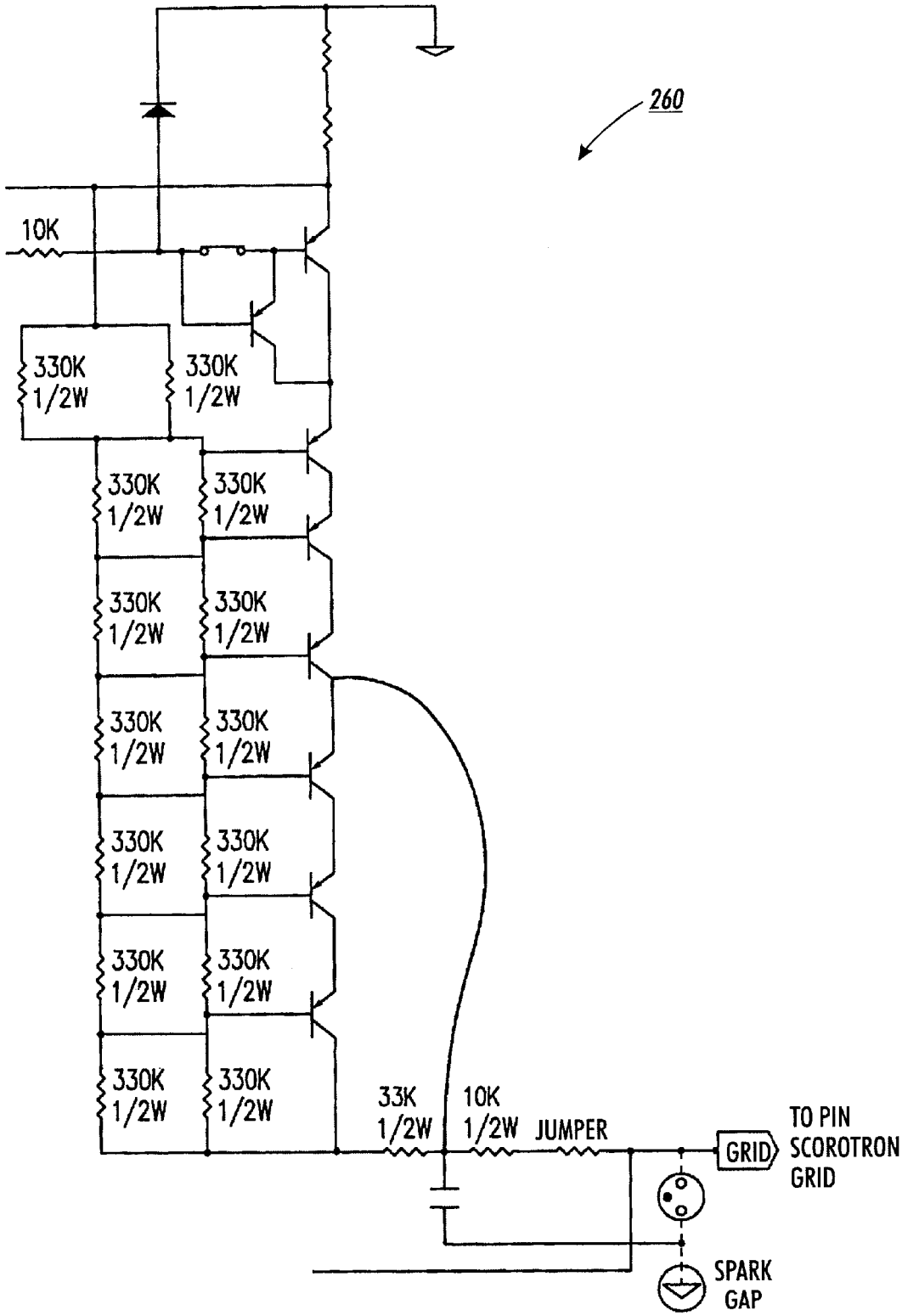
FIG. 3 (Prior Art)
FIG. 3 depicts an exemplary representation of a typical pin scorotron grid voltage control circuit.

FIG. 3 depicts in greater detail an exemplary representation of a typical grid voltage control circuit 260. The grid voltage control circuit 260, which is a simple shunt regulation circuit, contains seven cascaded pnp bipolar transistors that would be connected directly to the pin scorotron grid 245. This circuit, while effective in providing adequate power to drive the pin scorotron grid 245, is ineffective in providing reduced power dissipation in the high voltage power supply, which will improve electromagnetic emission profiles.

Figure 4:
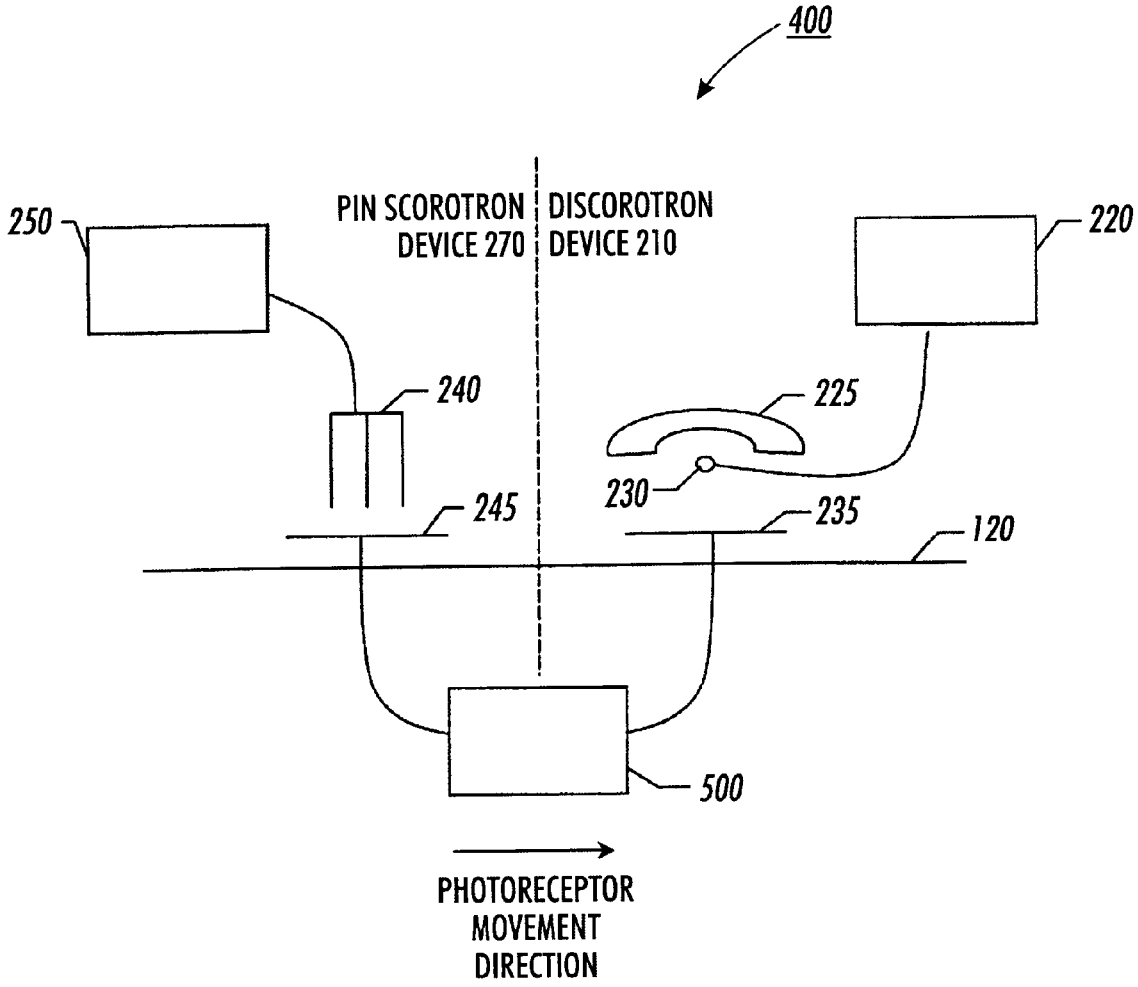
FIG. 4 depicts an exemplary embodiment of a charge/recharge circuit using a combined charge/recharge xerographic power supply according to this invention.

FIG. 4 depicts an exemplary embodiment of the charge/recharge xerographic power supply 400 according to this invention. As shown in FIG. 4, the charge/recharge xerographic power supply 400 comprises the pin scorotron device 270 and the discorotron device 210. In the pin scorotron device 270, as in conventional systems, a high-voltage DC signal is applied to the pins 240 by the pin current supply 250. The pin scorotron grid 245 is located between the photoreceptor 120 and the pins 240.

The discorotron device 210, as in conventional systems, comprises the shield 225 formed of aluminum or the like and having the open lower end, the corona discharge electrode 230, such as a glass coated tungsten wire or the like, extending within the shield 225, and the discorotron grid 235 disposed opposite the opening of the shield 225 and between the shield and the photoreceptor 120. The discorotron high-voltage AC source 220 is connected to the corona discharge electrode 230 to produce the corona discharge.

Figure 5:
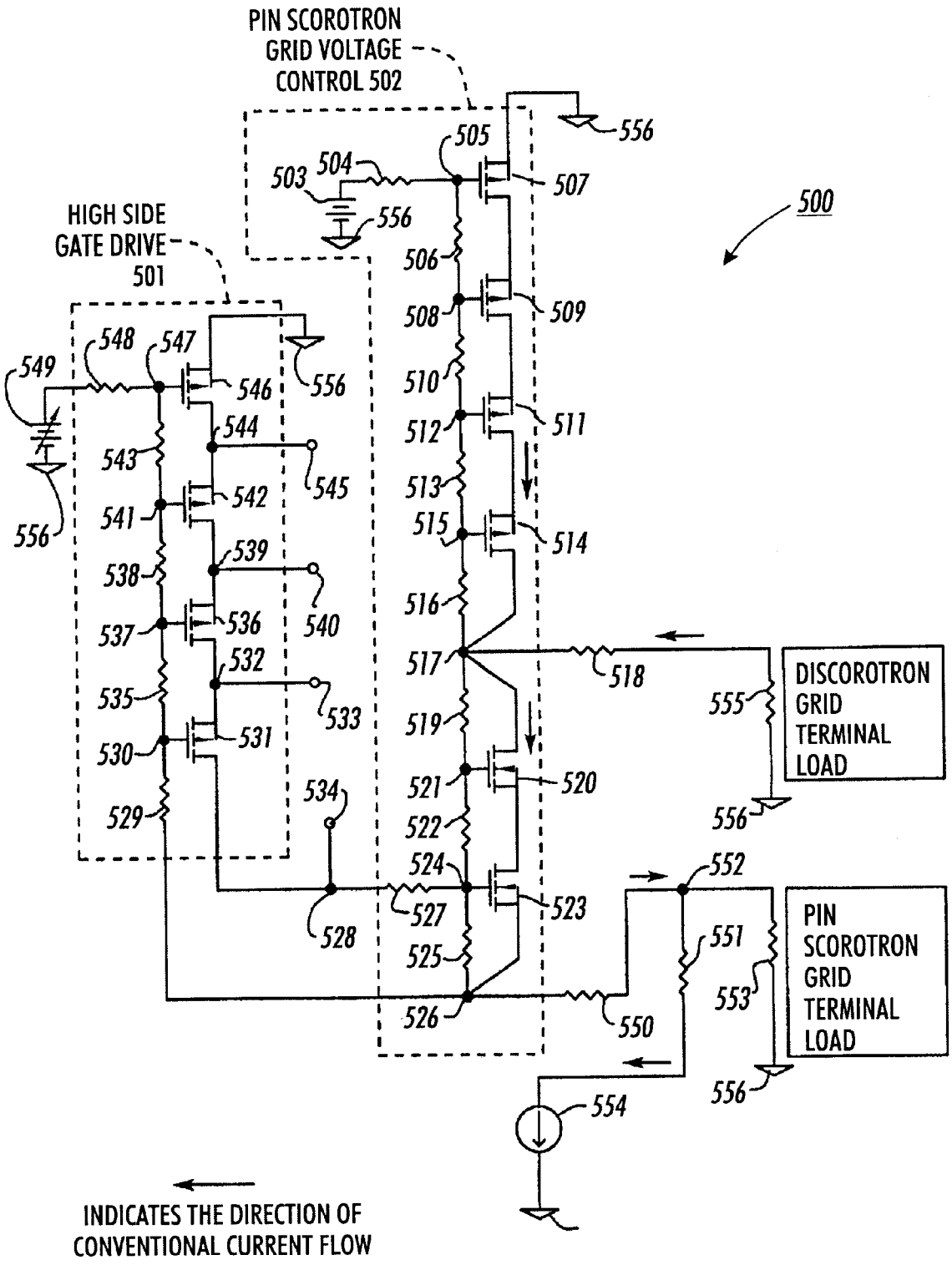
FIG. 5 is a schematic diagram of one exemplary embodiment of the circuit elements of the combined charge/recharge xerographic power supply of FIG. 4 according to this invention.

However, as shown in FIG. 4, the separate pin scorotron grid voltage control circuit 260 and the separate grid voltage active control circuit 215 of the conventional system are replaced by a single combined charge/recharge power supply 500. That is, the pin scorotron grid 245 is held at a constant voltage and the discorotron grid 235 is driven by the combined charge/recharge power supply 500. This configuration recycles the power provided from the pin scorotron grid 245 to drive the discorotron grid 235 through a series pass regulation circuit. FIG. 5 shows the current flow direction and demonstrates that the current from a shunt regulation circuit naturally flows in a proper direction to allow shunt regulation of the pin scorotron grid 245 while also providing an active drive voltage for the discorotron grid 235.

FIG. 5 shows in greater detail a schematic diagram of one exemplary embodiment of the circuit elements of the combined charge/recharge xerographic power supply 500. The combined charge/recharge power supply 500 has two main sections 501 and 502. The first main section 502 is a pin scorotron grid voltage control circuit 502. The second main section 501 is a high side gate drive circuit 501.

In FIG. 5, the pin current supply 250, pins 240 and the pin scorotron grid 245 are represented by current source 554 and resistors 551 and 553, respectively. Also in FIG. 5, the discorotron grid is represented by resistor 555. The discorotron high voltage AC source 220 and corona discharge electrode 230 are not shown in FIG. 5 because they have no particular bearing on the invention.

As shown in FIG. 5, the pin scorotron grid voltage control circuit 502 includes a positive terminal of a voltage source 503 connected to a first node 505 through a first resistor 504. The negative terminal of the voltage source 503 is connected to ground 556. Also connected at the first node 505 are a gate of a first p-channel MOSFET 507 and a second resistor 506. A drain of the first p-channel MOSFET 507 is connected to the common ground 556. A source of the first p-channel MOSFET 507 is connected to the drain of a second p-channel MOSFET 509.

The second resistor 506 is connected at a second node 508 to a gate of the second p-channel MOSFET 509 and a third resistor 510. Similarly, a source of the second p-channel MOSFET 509 is connected to a drain of a third p-channel MOSFET 511.

A third resistor 510 is connected at a third node 512 to the gate of the third p-channel MOSFET 511 and a fourth resistor 513. Similarly, the source of the third p-channel MOSFET 511 is connected to the drain of a fourth p-channel MOSFET 514.

The fourth resistor 513 is connected at node 515 to the gate of the fourth p-channel MOSFET 514 and a fifth resistor 516. Similarly, the source of the fourth p-channel MOSFET 514 and the other end of the fifth resistor 516 are connected to a fifth node 517. Also connected at the fifth node 517 are a sixth resistor 519, the source of a first n-channel MOSFET 520 and a first pull-up resistor 518.

The sixth resistor 519 is connected at a sixth node 521 to the gate of the first n-channel MOSFET 520 and a seventh resistor 522. Similarly, the drain of the first n-channel MOSFET 520 is connected to the source of a second n-channel MOSFET 523.

An eighth resistor 527 is connected at a seventh node 524 to the seventh resistor 522, a ninth resistor 525 and the gate of the second n-channel MOSFET 523. Similarly, the drain of the second n-channel MOSFET 523 is connected to the ninth resistor 525 at an eighth node 526. Also connected at the eighth node 526 is a second pull-up resistor 550 and a tenth resistor 529, which is a part of the high side gate drive 501. This configuration makes up the pin scorotron grid voltage control circuit 502.

The high side gate drive circuit 501 includes the positive terminal of a variable voltage source 549, which is connected to a ninth node 547 through an eleventh resistor 548. The negative terminal of the variable voltage source 549 is connected to ground 556. Also connected at the ninth node 547 is the gate of a fifth p-channel MOSFET 546 and a twelfth resistor 543. The drain of the fifth p-channel MOSFET 546 is connected to ground 556. Similarly, the source of the fifth p-channel MOSFET 546 is connected to a tenth node 544. Also connected at the tenth node 544 is a first tap terminal 545 and the drain of a sixth p-channel MOSFET 542.

A thirteenth resistor 538 is connected at an eleventh node 541 to the gate of the sixth p-channel MOSFET 542 and the twelfth resistor 543. Similarly, the source of the sixth p-channel MOSFET 542 is connected to a twelfth node 539. Also connected at the twelfth node 539 is a second tap terminal 540 and the drain of a seventh p-channel MOSFET 536.

A fourteenth resistor 535 is connected at a thirteenth node 537 to the gate of a seventh p-channel MOSFET 536 and the thirteenth resistor 538. Similarly, the source of the seventh p-channel MOSFET 536 is connected to a fourteenth node 532. Also connected at the fourteenth node 532 is a third tap terminal 533 and the drain of the eighth p-channel MOSFET 531.

The fourteenth resistor 535 is connected at a fourteenth node 530 to the gate of the eighth p-channel MOSFET 531 and the other end of the tenth resistor 529. Similarly, the source of the eighth p-channel MOSFET 531 is connected to a fifteenth node 528. Also connected at the fifteenth node 528 is a fourth tap terminal 534 and the other end of the eighth resistor 527.

As shown in FIG. 5, the high side gate drive circuit 501 is connected to the pin scorotron grid voltage control 502 at the eighth and fifteenth nodes 526 and 528, respectively.

Active current is supplied to the discorotron grid through the first pull-up resistor 518. The first pull-up resistor 518 is connected to ground 556 through the discorotron grid terminal load resistance. In this instance, the discorotron grid terminal load of the discorotron grid 235 is shown as a fifteenth resistor 555.

In operation of the combined charge/recharge power supply 500, as the voltage of the variable voltage source 549 is varied, the gate-to-source voltage of the first and second n-channel MOSFETs 520 and 523 is varied through the cascaded configuration of the high side gate drive circuit 501. Additionally, the voltage of voltage source 503 serves as the discorotron analog error voltage. The voltage supplied by the voltage source 503 serves to bias and stabilize the current supplied to the fifteenth resistor 555.

The second pull-up resistor 550 is connected between the eighth node 526 and a sixteenth node 552 to provide a path for current flow and shunt regulation of the pin scorotron grid 245. A sixteenth resistor 551 and the pin scorotron grid terminal load of the pin scorotron grid 245, which is shown in FIG. 5 as a seventeenth resistor 553, are connected at the sixteenth node 552. The seventeenth resistor 553 is also connected to ground 556. A current source 554 is connected to the sixteenth resistor 551. The current source 554 serves to drive the pin scorotron grid 245.

There are two constraints in the circuit shown in FIG. 5. The first constraint is that the voltage at the discorotron grid terminal load, i.e., at the fifteenth resistor 555, cannot exceed the voltage at the pin scorotron grid terminal load, i.e., the voltage at the seventeenth resistor 553. In this instance this means that the voltage at node 517 cannot be made more negative than the voltage at node 526. This constraint arises because the voltage supply for the discorotron grid 235 is derived from the pin scorotron grid 245. The second constraint stems from the same instance, in that the current flow into the terminal of the discorotron grid 235 cannot exceed the current flow from the terminal of the pin scorotron grid 245.

The first constraint can be overcome by adding a small transformer coupled DC to DC converter in series with resistor 550, with the positive terminal connected nearest to node 552. This source would allow the pin scorotron grid voltage to be maintained at a less negative voltage than required at the discorotron grid terminal. Using this method, several tens of volts are capable of being added to the output of the discorotron grid 235.

The second constraint does not particularly affect the operation of a system using this invention. This is true because, as previously discussed, the majority of the pin current is collected by the grid in the pin scorotron device 270. Thus, only a small portion is actually used to charge the photoreceptor 120. Similarly, only a small amount of DC current is required at the discorotron grid terminal to recharge the photoreceptor 120.

While this invention has been described in conjunction with the exemplary embodiment outlined above, it is evident that many alternative modifications and variations will be apparent to those skilled in the art. Accordingly, the exemplary embodiment of the inventions as set forth above, are intended to be illustrative, not limiting. Various changes may be made without departing from the spirit and the scope of the invention.

What is claimed is:

1. An image forming apparatus comprising:

a photoreceptor; and at least one charging unit that charges and recharges the photoreceptor to produce a uniform charge on the photoreceptor, comprising:

a pin scorotron device that charges the photoreceptor, and a discorotron device that recharges the charged photoreceptor, wherein a voltage from a grid of the pin scorotron device is recycled to drive a grid of the discorotron device.

2. The image forming apparatus of claim 1, wherein the voltage from the grid of the pin scorotron is supplied to the discorotron grid using a combined power supply circuit.

3. The image forming apparatus of claim 2, wherein the combined power supply circuit comprises a grid voltage control circuit that provides shunt regulation of the voltage supplied by the grid of the pin scorotron device.

4. The image forming apparatus of claim 2, wherein the combined power supply circuit comprises an active drive circuit that supplies an active drive voltage to the grid of the discorotron device.

5. The image forming apparatus of claim 2, wherein the combined power supply circuit comprises a variable voltage source that biases the voltage applied to the grid of the discorotron device.

6. The image forming apparatus of claim 2, wherein the combined power supply circuit comprises a voltage source that supplies a discorotron analog error voltage, wherein the discorotron analog error voltage biases and stabilizes the voltage supplied to the discorotron grid.

7. The image forming apparatus of claim 1, further comprising at least one controller that controls the image forming apparatus to produce a visible image.

8. The image forming apparatus of claim 7, further comprising at least one exposing unit usable to expose the photoreceptor based on an original document to produce a latent image on the photoreceptor.

9. The image forming apparatus of claim 8, further comprising at least one developing unit controlled by the at least one controller to apply a developing material to the latent image to develop the latent image on the photoreceptor into the visible image.

10. The image forming apparatus of claim 9, wherein the image forming apparatus brings at least one image receiving member into contact with the visible image to transfer the visible image to the at least one image receiving member.

11. The image forming apparatus of claim 1, further comprising at least one controller that controls the image forming apparatus to produce multi-layer images.

12. The image forming apparatus of claim 11, further comprising at least one exposing unit usable to expose the photoreceptor based on an original document to produce at least one latent image on the photoreceptor.

13. The image forming apparatus of claim 12, further comprising at least one developing unit controlled by the at least one controller to apply a developing material to the at least one latent image to develop the at least one latent image on the photoreceptor into a visible image.

14. The image forming apparatus of claim 13, wherein the image forming apparatus brings at least one image receiving member into contact with the visible image to transfer the visible image to the at least one image receiving member.

15. A charging unit that charges and recharges a photoreceptor to produce a uniform charge on the photoreceptor, comprising:

a pin scorotron device that charges the photoreceptor, and a discorotron device that recharges the charged photoreceptor, wherein a voltage from a grid of the pin scorotron device is recycled to drive a grid of the discorotron device.

16. The charging unit of claim 15, wherein the voltage from the grid of the pin scorotron is supplied to the discorotron grid using a combined power supply circuit.

17. The charging unit of claim 16, wherein the combined power supply circuit comprises a grid voltage control circuit that provides shunt regulation of the voltage supplied by the grid of the pin scorotron device.

18. The charging unit of claim 16, wherein the combined power supply circuit comprises an active drive circuit that supplies an active drive voltage to the grid of the discorotron device.

19. The charging unit of claim 16, wherein the combined power supply circuit comprises a variable voltage source that biases the voltage applied to the grid of the discorotron device.

20. The charging unit of claim 15, wherein the combined power supply circuit comprises a voltage source that supplies a discorotron analog error voltage, wherein the discorotron analog error voltage biases and stabilizes the voltage supplied to the discorotron grid.

* * * * *